United States Patent [19]

Lanning

[11] Patent Number: 4,512,263

[45] Date of Patent: Apr. 23, 1985

[54] DEPOSITORY APPARATUS WITH SEQUENTIAL STACKING

[75] Inventor: Frederick E. Lanning, Concord, N.C.

[73] Assignee: International Business Machines Corporation, Armonk, N.Y.

[21] Appl. No.: 492,321

[22] Filed: May 6, 1983

[51] Int. Cl.[3] ..... E05G 1/00; E05G 5/00

[52] U.S. Cl. ..... 109/66; 109/24.1; 271/181

[58] Field of Search ..... 109/24.1, 66, 68, 69, 109/73, 74, 75; 271/177, 180, 181, 214–217, 213, 219, 294, 306; 346/22

[56] References Cited

U.S. PATENT DOCUMENTS

| | | | |
|---|---|---|---|
| 682,221 | 9/1901 | Mosler | 109/66 |
| 2,659,907 | 11/1953 | Kramer | 271/181 |
| 3,655,186 | 4/1972 | Bayha | 271/88 |
| 3,782,297 | 1/1974 | Van Dalen | 109/66 |

FOREIGN PATENT DOCUMENTS

| | | | |
|---|---|---|---|
| 1138876 | 6/1957 | France | 271/181 |
| 1497426 | 1/1978 | United Kingdom . | |

*Primary Examiner*—Thomas J. Holko
*Assistant Examiner*—Neill Wilson
*Attorney, Agent, or Firm*—Karl O. Hesse

[57] ABSTRACT

A depository apparatus capable of sequential stacking deposits comprises a transfer duct movable from a position solely in communication with a storage chamber to a second position solely in communication with an external deposit aperture. The storage chamber is separated into a storage zone and a receiving zone, the latter being the portion of the chamber in communication with the transfer duct. The two zones are separated one from the other by a one way gate system that allows a pusher element to push deposits from the receiving zone into the storage zone against an oppositely biased stacker plate movably mounted in the storage zone.

6 Claims, 5 Drawing Figures

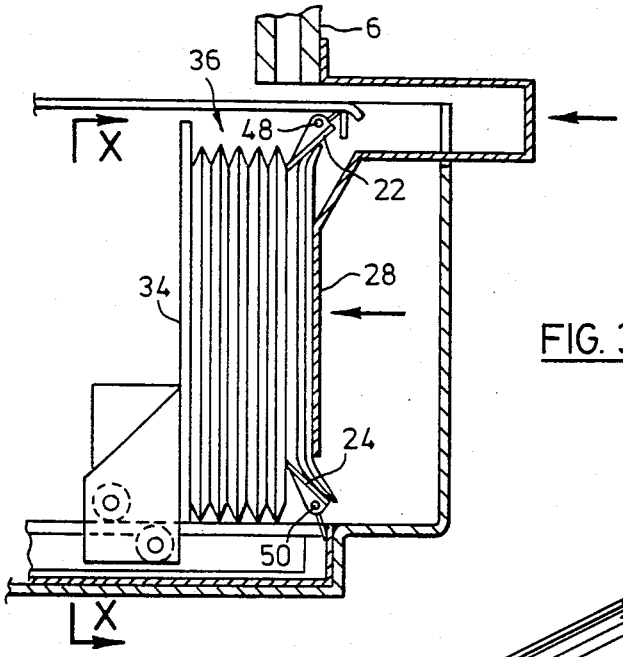
FIG. 3
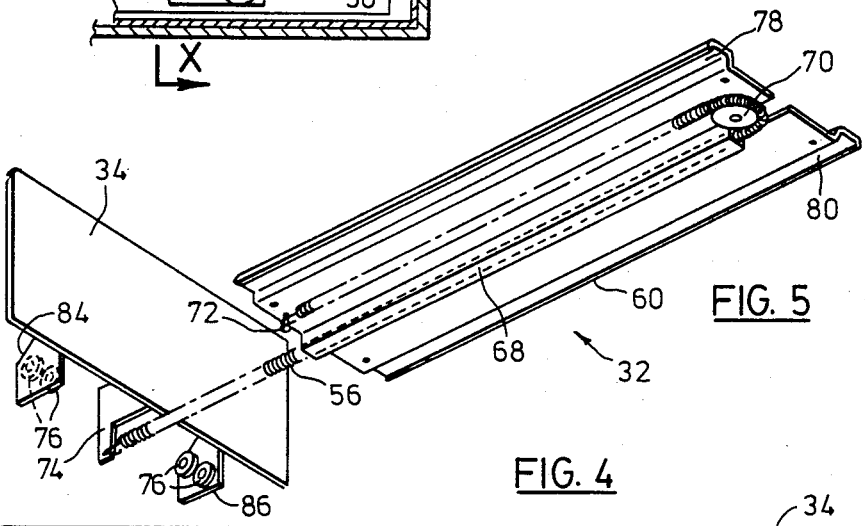
FIG. 5
FIG. 4
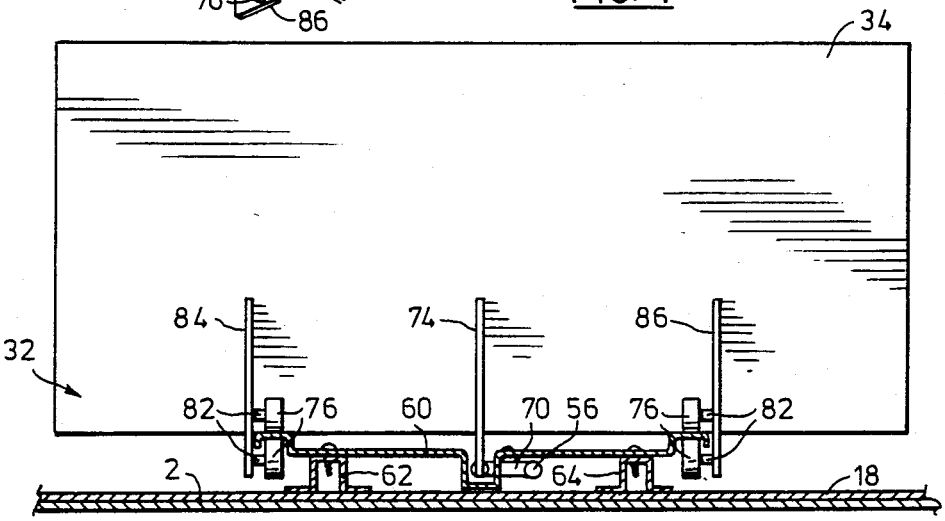

DEPOSITORY APPARATUS WITH SEQUENTIAL STACKING

FIELD OF THE INVENTION

This invention relates in general to unattended, self-service banking terminals and the like, and is more particularly directed to an improved depository apparatus that provides security and the sequential stacking of deposits while retaining simplicity of design.

BACKGROUND OF THE INVENTION

To illustrate the state of the depository art, in a general way, reference is made to three U.S. patents, namely:

1. U.S. Pat. No. 2,923,587, to A. R. Zipf, dated Feb. 2, 1960;
2. U.S. Pat. No. 3,942,435, to T. R. Aultz, dated Mar. 9, 1976;
3. U.S. Pat. No. 4,119,269, to B. Soderberg, dated Oct. 10, 1978.

The Zipf patent illustrates in FIG. 2 an automatic receiving teller, or depository, in which a feed roller system is employed to conduct deposits from an external access aperture to a vertically oriented stacker bin.

Deposits are fed to the bin, and onto an elevator plate mounted on a driving lead screw. As each deposit arrives, the elevator plate is lowered a predetermined amount.

Thus, Zipf requires a motor and a special drive the length of the depository, and is dependant for initiation of the stacking drive upon each deposit having adequate bulk and mass to contact and operate a drive controlling microswitch.

In the Aultz et al patent, no sequential stacking means is provided in the vault, and the conducting means in the form of a pivotable transfer tube includes a linkage operable to move an imprinting means into a printing position relative to a deposit in the tube. In this way, any given deposit is correlated with its respective transaction when the contents of the vault are removed by bank personnel.

Turning to the Soderberg patent, this presents a somewhat simplified deposit conducting or transfer means adapted to afford the desired security against improper actions such as "fishing". However, no provision is made in Soderberg to permit sequential stacking. Further, a relatively complex locking means is required to ensure that the insert hatch is locked before access can be had to the access port leading into the deposit storage area.

Considering this prior art, there is clearly a need for a secure depository apparatus that will provide for the sequential stacking of deposits with the simplicity and reliability necessary in a remote or unattended facility.

BRIEF DESCRIPTION OF THE INVENTION

In accordance with the present invention, a depository apparatus for use in an automated banking facility or the like is characterized by separating the depository storage chamber into a receiving zone and a storage zone by a one way gate means that only permits the passage of deposits from the receiving zone into the storage zone, and providing a pusher means responsive to the operation of a deposit conducting means to push deposits in the receiving zone through the gate means and into the storage zone against a stacker element whereby the sequential stacking of deposits is accomplished.

A further aspect of the present invention resides in the provision of a simple, reliable conducting means for conducting deposits from an external deposit aperture to the receiving zone of the depository storage chamber combined with the pusher and stacker means discussed immediately above.

Further benefits and advantages to be reaped from the present invention will become apparent from the following detailed description of a preferred embodiment of the invention, taken in conjunction with the following drawings.

BRIEF DESCRIPTION OF THE DRAWINGS

FIG. 3 is a partial view of FIG. 1 showing a deposit envelope being pushed into the storage areas;

FIG. 4 is a cross-sectional view taken along lines x—x in FIG. 3;

FIG. 5 is a partially exploded underview, in perspective, of the stacker plate assembly.

DETAILED DESCRIPTION OF AN EMBODIMENT

Figure 1:
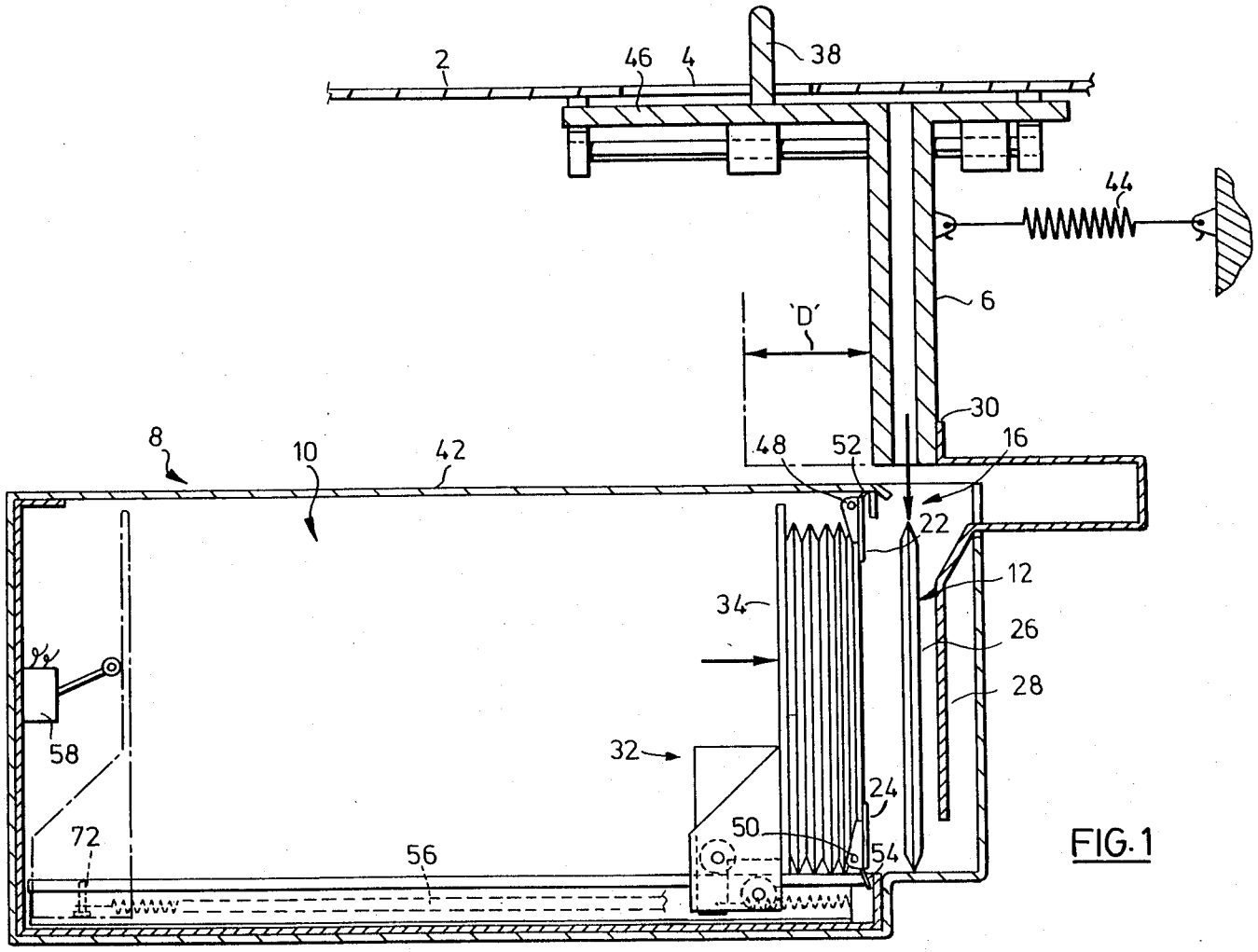
FIG. 1 is a schematic elevation of an apparatus embodying the presention invention.

With reference to FIG. 1, a sequentially stacking depository in accordance with the present invention, in one embodiment, comprises a substantially enclosed housing 2 (only partially shown), having a deposit aperture 4 through which deposits may be introduced following the satisfactory completion of appropriate transaction steps. The various well-known security and transaction methods that could be used with the present invention form no part of the invention herein and are thus omitted.

Broadly, the depository apparatus shown in FIG. 1 comprises a duct member 6 and a storage chamber 8 that is divided into a storage zone 10 and a receiving zone 12 by gate means to be described hereinafter.

The receiving zone 12 communicates with duct member 6 through an access aperture 16.

The storage zone 10 preferably receives a storage cartridge 18 (FIG. 2) that will also be described in greater detail hereinafter.

The two zones 10 and 12 are separated by one way gate means (see FIG. 2), which may be a part of the cartridge 18, or, if the apparatus is desired without cartridges, can be mounted directly on the housing structure 2.

The gate means comprises a pair of opposed flap members 22 and 24 which do not extend fully across the width of the cartridge 10 (or the chamber 8), the opposed free ends of flap member 22 and 24 defining a gap to permit passage of an envelope 26 and a pusher member 28 which, in the illustrated embodiment is connected to duct member 6, as at 30, by any suitable means (not shown).

It will be understood that pusher member 28 need not be connected directly to duct member 6. It is only necessary to arrange for movement of pusher member 28 in response to operation of duct member 6, and such an interconnection is, of course, well within the skill of any person skilled in the art.

Figure 2:
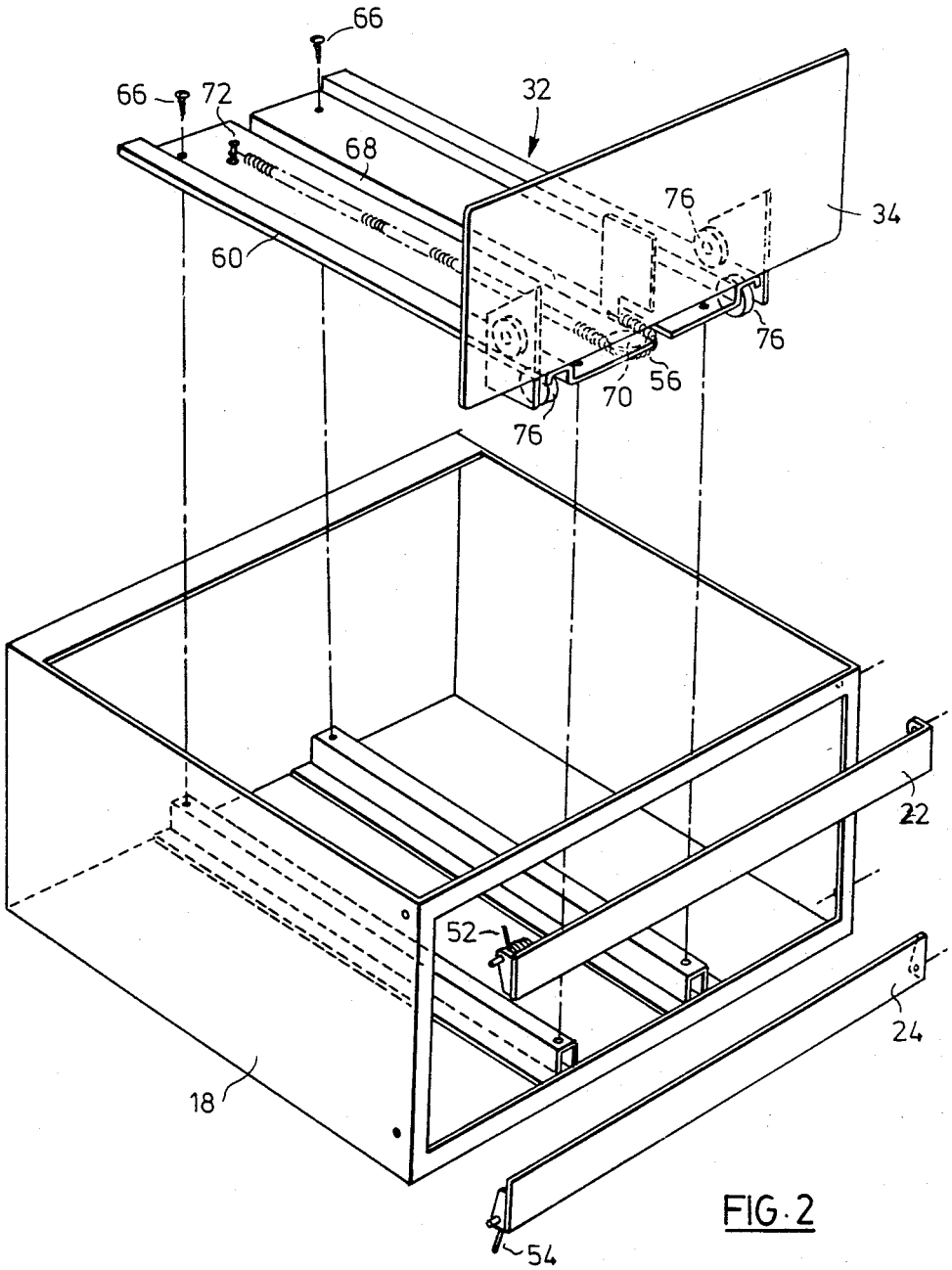
FIG. 2 is a perspective, schematical representation of a storage cartridge and an exploded view of the stacker plate mechanism.

Movably mounted within the storage zone 10, or, as in the case of the embodiment being described, incorporated into cartridge 18, is a stacker plate assembly 32, (see FIGS. 2, 4 and 5). The stacker plate 34 itself is biased towards the gate system described above and is thus effective to press sequentially stacked envelopes 36 (FIG. 3), or the like, against the rear surfaces of flap members 22 and 24.

In operation, the duct member 6 is moved to the left as viewed in FIG. 1, by manual means (lever 38) or by a powered mechanism (not shown). Since simple, automatic mechanisms for effecting the desired movement of duct 6 are well known and form no significant part of the invention, it is not deemed necessary to include a particular example, and the manual system is disclosed in the interests of simplicity. Further, while lever 38 must obviously be lockable, such detail is omitted also, since the invention per se is not dependent upon such ancillary matters.

Moving duct member 6 to the left through a distance "D" brings the latter into communication with depository aperture 4, while the lower end of duct 6 is effectively closed by a deck element 42 of the housing structure 2. A deposit envelope may now be inserted into duct 6 through aperture 4 while access to the interior of the depository is precluded.

Release of lever 38 allows the tension spring 44 to return the duct 6 into communication with the access port 16 of the storage chamber 8, and more particularly with receiving zone 12. At the same time, the laterally extending flange 46 of duct 6 moves back to close off the depository aperture 4 thus maintaining security against access to the storage chamber.

With the return of duct 6 to its home position, the envelope 26 drops into the receiving zone 12 between pusher member 28 and the gate system, a position where it is secure from external "fishing".

When the next deposit is made through aperture 4 into duct 6, i.e., when the lever 38 is moved to the left, it will be seen that pusher 28 moves envelope 26 to the left (in FIG. 1) and the edges of the envelope contact respective flap members 22 and 24 pivoting the latter about their pivots 48 and 50, and against the bias of their torsion springs 52 and 54 (see FIG. 3.)

This action of the pusher 28 also forces the center of the envelope against the stacker plate 34 directly or through stacked envelopes 26, forcing plate 34 back (to the left) against the stacker assembly tension spring 56, (see FIGS. 2, 4, and 5).

The stroke of duct 6 is designed to ensure adequate movement of the envelope 36 to pass by the flap members 22 and 24 and as will be appreciated, retraction of the pusher 28 results in the stacker plate 34 returning the envelope(s) against the rear surface of the flap members (22 and 24) which are returned to closed position by their torsion springs after the envelope has moved far enough to the left.

A limit switch 58 in FIG. 1 emits a signal when contacted by the stacker plate, thus indicating that the chamber 8, or the cartridge 18 is full, or at least has accepted its designed load.

Turning to FIGS. 2, 4 and 5, the stacker assembly 32 comprises a bed plate 60 which is secured on a pair of longitudinally extending raised ribs 62 and 64 in cartridge 18 (or chamber 8) as by screw fastening means 66.

Plate 60 has a central channel 68 in which the tension spring 56 is entrained, the latter bending around pulley 70 and being anchored by a fixed stud 72.

The other end of tension spring 56 is connected to the depending lug 74 which is attached to stacker plate 34 (See FIG. 5), and for stability, stacker plate 34 is provided with two pairs of spaced, staggered rollers 76 which run on the respective outer and inner surfaces of channels 78 and 80.

Rollers 76 are rotatably mounted on studs 82 fixed in stacker plate flanges 84 and 86 which flank the lug 74.

While a single embodiment of the present invention has been described, those skilled in the art will perceive numerous equivalent and alternative means for putting the present invention into practice without departing from the spirit and scope of such invention.

I claim:

1. An improved depository apparatus, for use in an automatic banking system or the like, comprising:

housing means having a deposit aperture formed therein:

a substantially closed depository storage chamber within said housing means, said chamber having an access port displaced relative to said deposit aperture;

an open-ended duct member mounted within said housing means for movement between a first position for communication solely with the storage chamber access port, and a second position for communications solely with said deposit aperture;

operating means effective to provide for movement of said duct member between said first and second positions;

said depository storage chamber having a receiving zone in communication with said access port, and a storage zone;

gate means mounted between said receiving zone and said storage zone to permit one-way passage of deposits from said receiving zone to said storage zone; and, pusher means mounted in said housing means for movement responsive to operation of said duct member to push a deposit located in said receiving zone through said gate means and into said storage zone to thereby effect sequential stacking of deposits.

2. A depository apparatus as defined in claim 1 and further including a stacker plate mounted in the storage zone of said storage chamber for movement towards and away from said gate means; and, biasing means for urging said stacker plate towards said gate means whereby deposits pushed into said storage zone are maintained in sequentially stacked arrangement.

3. A depository apparatus as defined in claim 2 wherein said gate means comprises a pair of opposed flap members constrained for pivotal opening movement solely inwardly of said storage zone, and biasing means for returning said flap elements from an open position to a normally closed position.

4. A depository apparatus as defined in claim 1 wherein said duct member includes a substantially laterally extending flange, said flange closing said deposit aperture when said duct member is in said first position.

5. A depository apparatus as defined in claim 1 or 4 wherein said housing means includes a closure element located adjacent the access port of said depository chamber, said closure element blocking one end of said duct member when the duct member is in said second position.

6. A depository apparatus as defined in claim 1 wherein said open ended duct member is mechanically connected to said pusher means for operation of said pusher means in synchronism with the operation of said duct member.

* * * * *